US007096875B2

(12) United States Patent
Dubinsky-Witkowski

(10) Patent No.: US 7,096,875 B2
(45) Date of Patent: Aug. 29, 2006

(54) ANIMAL UMBRELLA

(75) Inventor: Martha Dubinsky-Witkowski, Tarrytown, NY (US)

(73) Assignee: Zipjack Industries, Ltd., Elmsford, NY (US)

( * ) Notice: Subject to any disclaimer, the term of this patent is extended or adjusted under 35 U.S.C. 154(b) by 0 days.

(21) Appl. No.: 11/068,404

(22) Filed: Feb. 28, 2005

(65) Prior Publication Data

US 2005/0145272 A1 Jul. 7, 2005

Related U.S. Application Data

(63) Continuation-in-part of application No. 10/713,125, filed on Nov. 14, 2003.

(51) Int. Cl.
*A45H 15/28* (2006.01)

(52) U.S. Cl. ..... 135/98; 135/96; 135/16; 446/478; 43/1

(58) Field of Classification Search ..... 135/16, 135/15.1, 20.1, 98, 96, 21, 33.2, 115, 901, 135/910; 43/1–3; 446/7, 478, 487–490, 446/370–375, 149; 472/116–117, 136; 40/212; D3/5–6; D21/834–836
See application file for complete search history.

(56) References Cited

U.S. PATENT DOCUMENTS 2,221,366 A * 11/1940 Bisbing et al. ..... 135/16
2,502,984 A * 4/1950 Parmenter ..... 135/33.7
2,943,634 A * 7/1960 Morgan ..... 135/96
3,899,168 A * 8/1975 Besherse ..... 472/75
4,364,193 A * 12/1982 Visco ..... 43/1
4,880,023 A * 11/1989 Lin ..... 135/15.1
D325,296 S * 4/1992 Wu ..... D3/6
5,158,102 A * 10/1992 Lemcke ..... 135/16
5,345,961 A * 9/1994 Yercha et al. ..... 135/87
D383,900 S * 9/1997 Bart ..... D3/6
5,678,587 A * 10/1997 Bilotti ..... 135/98
6,223,758 B1 * 5/2001 Feldman ..... 135/33.2
6,227,216 B1 * 5/2001 Dweck ..... 135/15.1
6,296,005 B1 * 10/2001 Williams et al. ..... 135/98
6,385,895 B1 * 5/2002 Scaries ..... 43/2
6,698,440 B1 * 3/2004 Beyer et al. ..... 135/25.41
6,752,164 B1 * 6/2004 Park ..... 135/136

FOREIGN PATENT DOCUMENTS

JP 10-192022 * 7/1998

* cited by examiner

*Primary Examiner*—Winnie Yip
(74) *Attorney, Agent, or Firm*—Milde & Hoffberg, LLP

(57) ABSTRACT

A creative, protective play space device for children comprising an umbrella like structure which represents an animal, and in which the extremities of the animal, such as the head and the tail, extend beyond the end of the umbrella ribs, and fall toward the ground, creating the partial walls of the play space, which may be completed with netting fabric.

20 Claims, 7 Drawing Sheets

ANIMAL UMBRELLA

CROSS-REFERENCE TO RELATED APPLICATION

This application is a continuation-in-part of application Ser. No. 10/713,125, filed Nov. 14, 2003 entitled "ANIMAL UMBRELLA".

FIELD OF THE INVENTION

The present invention relates to decorative umbrellas, and to protective spaces, such as tents, and creative play spaces, such as stage sets, for children.

BACKGROUND OF THE INVENTION

The present invention provides a protective and creative, play space device, which in a preferred embodiment may be structured like an umbrella, e.g., with a frame and cloth cover which may be formed of separate panels, stitched together to form a domed canopy. However, the cloth panels extend lower than those of a conventional umbrella, creating a partial tent-like space underneath. In addition, the play space has the general shape and/or coloring of an animal.

There are many commercial examples of children's umbrellas wherein the color of the cover of the umbrella, and decorative appliqués thereon are chosen to evoke animals. There are umbrellas resembling a turtle, a bee, and the head of a duck, with one panel extended to form the duck's bill. In addition, U.S. Pat. Nos. 5,158,102 and 6,227,216 B1 describe umbrella structures which include ear-like projections for an umbrella, to make it more closely resemble an animal. Eared umbrellas sold for children include a lion, and a cat. The "ear" projections have also been adapted to form the eyes of a frog and a ladybug, and the wings of a butterfly and a bee. The canopy, or cover, of these umbrellas is not very high. Though they may find secondary use in play, they do not, by themselves, form a protected play space.

Children often form makeshift, tent-like structures to play under. These structures can be as simple as a blanket thrown over a bed, a table, or an umbrella. U.S. Pat. No. 5,345,961 discloses a cardboard tent made of two side panels, and a triangular back panel, with pictures of animals on each side panel. The contained space of a tent can provide a contained, creative play space, much as the stage of a theater. However, the opportunity to hide, or be concealed in a tent is not always appropriate for children, or what they desire, especially on a sunny day.

U.S. Pat. No. 6,223,758 B1 discloses an umbrella structure with a height greater than that of a conventional children's umbrella. The structure has transparent portions to see through for safe navigation. The transparent portions may be provided with eyelashes, and the umbrella structure may also bear a smile. Additionally the umbrella rod may be provided with a pair of hands, forming arms, and a pair of handles forming feet.

U.S. Pat. No. 6,385,895 depicts an animal decoy constructed of an animal shaped cover over an umbrella-like frame. The frame has a number of struts extending from a shaft, including a head strut, 112, to create the head of the decoy. All of the struts are collapsible. None of the panels falls beyond the struts to form a play space. In addition, all of the struts freely rotate, a construction which is said to give the decoy realistic movement, but which would be dangerous in a play space device for children.

SUMMARY OF THE INVENTION

The present invention provides a creative, protective play space device for children. The device comprises a framework with a cover, which depicts an animal. Portions of the cover, such as those depicting the extremities of the animal, such as the head, legs and the tail, extend beyond the end of the framework, and fall toward the ground, creating the partial walls of the play space.

In a preferred embodiment, the framework of the play space device has a post, which may be hand-held in the case of a small play space device, or, in the case of a larger device, may be used to stand the device, in e.g., an umbrella-type stand. The framework also has a plurality of ribs, connected at one end thereof to the post, and framing means for maintaining the ribs at an angle to the post. Disposed on the framework is a cover of protective material, which may be e.g., woven or non-woven cloth or plastic. The material is disposed atop the ribs, and attached to at least one of said ribs. A portion of the cover extends beyond the free end of the ribs, extending toward the ground, creating the partial walls of a protective creative play space.

In one embodiment of the protective, creative play space device for children, the cover may be formed of a spiral array of generally triangular panels, which form a dome-like shape when the framework is fully erected. In this embodiment, the ribs are pivotably connected to the post, so they can be collapsed for storage, but raised to erect the canopy framework and extend the cover to display the animal.

In one embodiment, the panels of the cover, which depict portions of the animal, extend between the ribs. For instance, one of the panels may depict a head portion of the animal. Another panel may comprise a tail portion. Other panels may comprise leg portions, or wing portions, or a number of panels may comprise a body shell.

In an alterative construction, the rib attachment to the post does not define panels between the ribs, but at least one rib is attached to the mid-portion of at least one panel so as to shape the panel. In still another alternative, additional framing, such as an additional radial strut, cross strut, or molded portion, such as a molded nose, may be provided. For instance, the cover may be attached such that a rib, or other frame portion, extends e.g. the brow of the head of an elephant, or the long neck of a flamingo.

In a preferred embodiment of the protective, creative play space device may have 4 ribs, to define a head panel, a tail panel, and two panels on which the legs may be depicted. Another preferred embodiment has 6 ribs, defining head and tail panels, and four leg panels.

In still another preferred embodiment, the protective, creative play space device of the present invention may have 8 ribs, defining 8 panels; a head panel, a tail panel, two torso panels, and four leg panels.

The protective, creative play space device of the present invention may by used in making a hand-held, rain or shade umbrella, provided the walls of the device do not obstruct the view too much. In addition, the device may be used to create awning-type structures that provide play spaces in e.g., playgrounds, or dining facilities, especially outdoor restaurants. The device provides a play space without permitting children to actually hide. The device encourages playfulness among children, while permitting supervised playtime. The devices are intended to be attractive, and to draw the attention of a child, encouraging their participation in playing or dining, under the device. The devices may be constructed so as to be collapsible, much as an umbrella, so as to be easily portable. Thus devices of the present invention may be easily rented and deployed for parties, or used for e.g. seasonal deployment, such as a seasonal outdoor restaurant.

In summary, the present invention provides a protective, creative play space device for children, comprising a framework and a cover representing an animal. The framework comprises a post and ribs to create a dome-shaped canopy. Each rib is connected at one end thereof to the post, and a framing means maintains the rib at an angle to the post. The cover, which may be made of a waterproof, or other protective material, such as UV shade material, is disposed about and atop the ribs, and a portion of the cover extends beyond the other end of the ribs, creating a portion of the cover that falls toward the ground, making the partial walls of the protective creative play space device.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
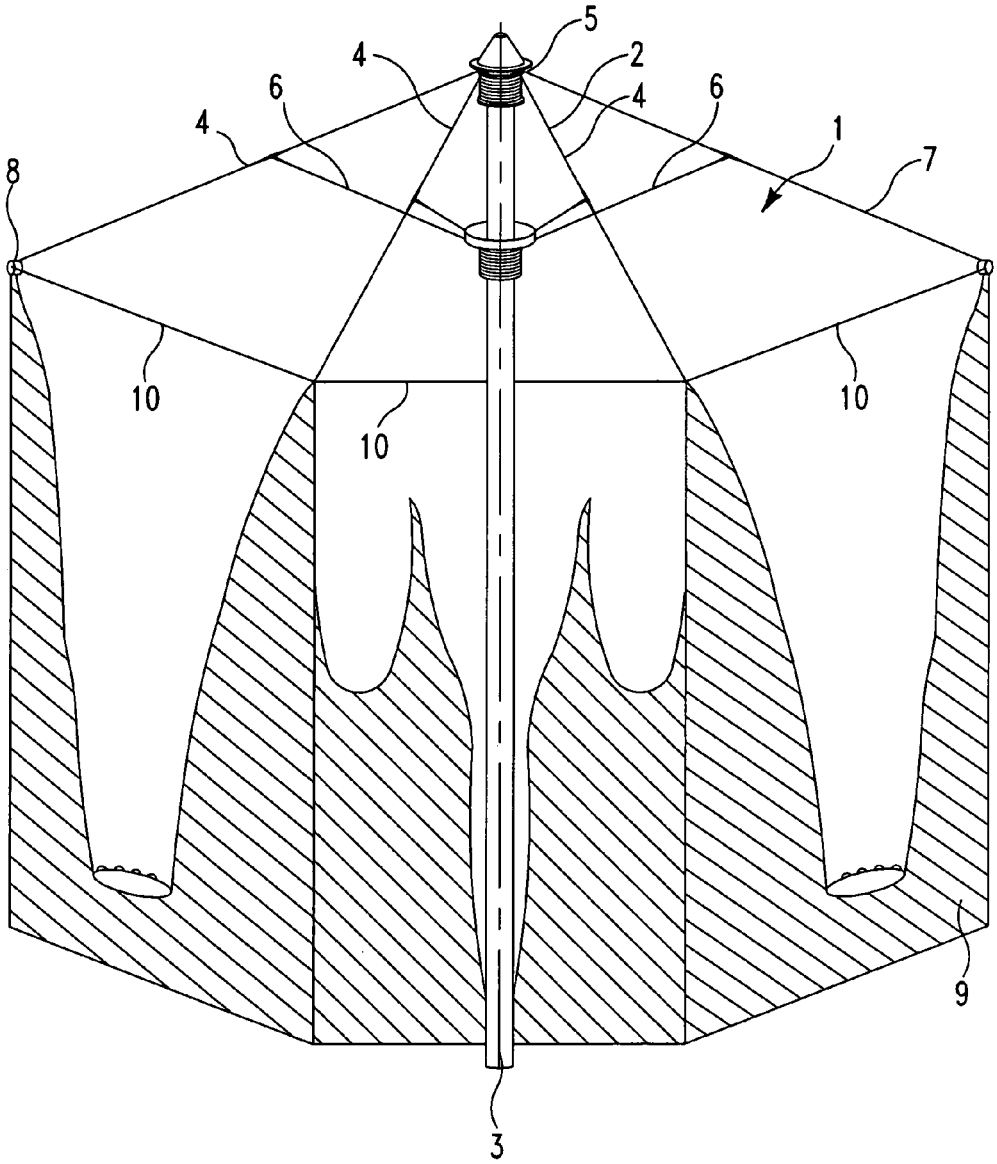
FIG. 1 is a side view in partial cross-section of one embodiment of the play space device of the present invention, illustrating the inside of the play space.

The preferred embodiments of the present invention will now be described with reference to FIGS. 1–8A of the drawings. Identical elements in the various figures are designated with the same reference numerals.

FIG. 1 illustrates a creative play space device according to the present invention. The device, shown generally at 1, has a framework 2. In this embodiment, the framework comprises a post 3, and a plurality of ribs 4. The ribs are connected at one end 5, to the post. This connection may comprise a permanent attachment or release-able attachment, as with an awning; or a pivotable connection as with a collapsible umbrella. The framework may also have additional framing means, such as at 6, to maintain the ribs at a fixed angle to the post. The device also comprises a cover, 7 which can be manufactured of woven or non-woven cloth, canvas, plastic sheeting material, or soft foam sheeting. It is preferred that the material of the cover be water repelling, though this is not required. As shown in FIG. 1, the cover is attached to the framework, as at 8. This attachment may also be permanent, or release-able, but must safely secure the cover to the framework during use. In a preferred embodiment the cover is attached to at least a number of ribs to stabilize it on the framework.

Figure 2:
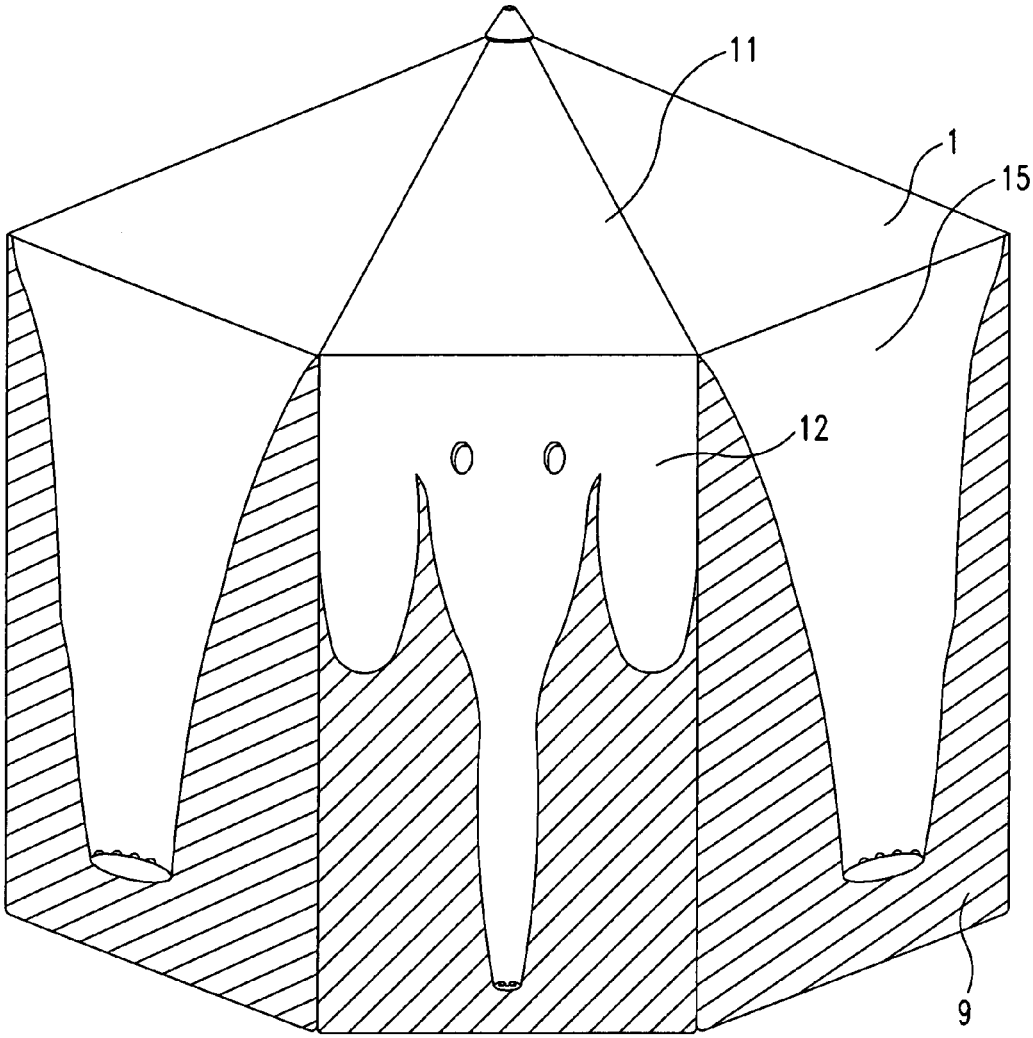
FIG. 2 is a front side view of the embodiment of the present invention shown in FIG. 1.
Figure 2A:
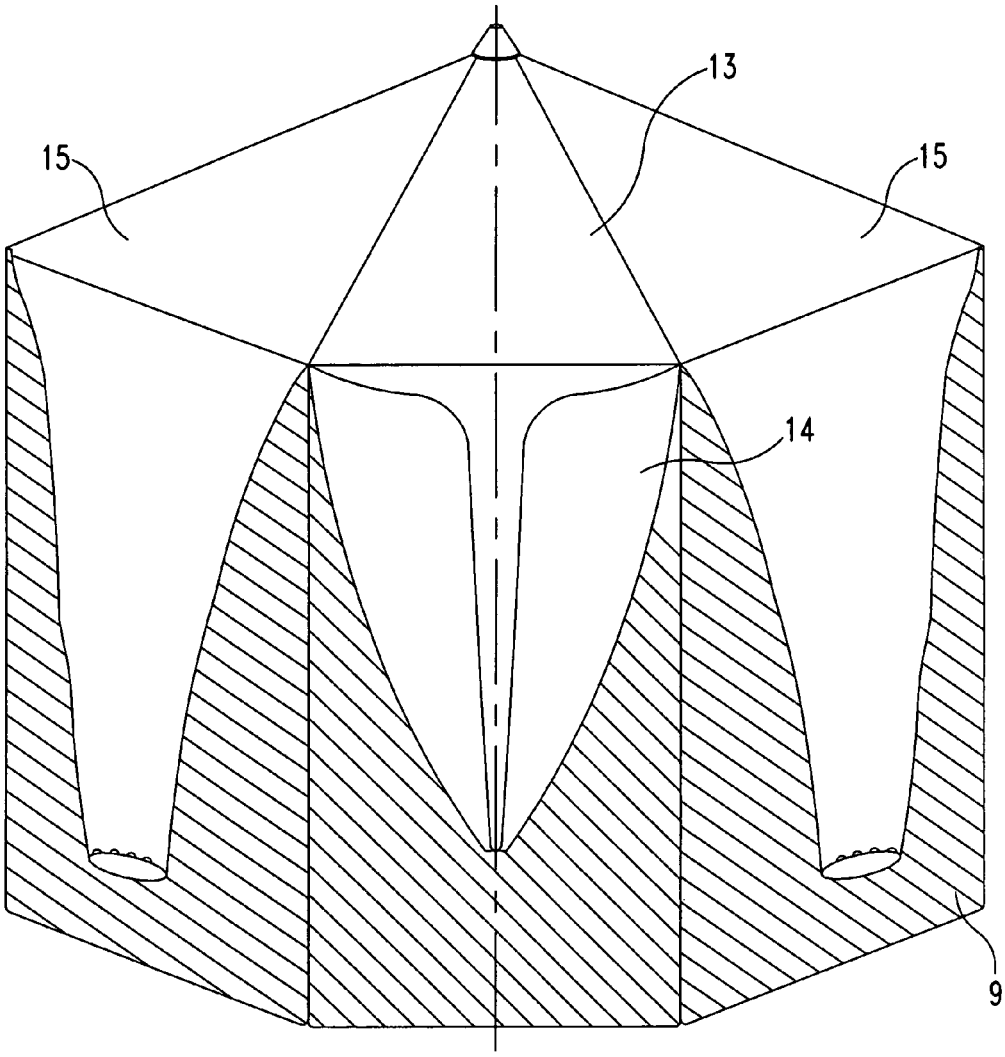
FIG. 2A is a backside view of the embodiment of the present invention shown in FIG. 1.

The cover extends past the outer ends, 5A, of the ribs, such as at 12, 13 and 15 in FIGS. 2 and 2A. These trailing portions of the panels hang down, toward the ground, creating a closed in protective play space, which none-theless is open to light and air. As shown in FIG. 2, the head panel 11 has an extended panel portion 12, 15 is the extended trailing portion of the leg panel, while 14 is the extended portion of the tail panel 13. Through the extended trailing portions of the panels falls toward the ground due to gravity and their own weight, a natural breeze, or forced air, may move the extended panels, to cause the animal to appear in motion. A see-through netting fabric, 9, may be added to the trailing portions, such as seam line 10, in FIG. 1, to create a more complete tent or canopy-type structure, providing added containment, which enhances the play value, and provides added protection from e.g., sun and insects.

The cover is painted, dyed, colored, appliquéd, or otherwise constructed to represent the outer surface of the body of an animal. Because of the front side of the device is cut-away in FIG. 1, only the inner surface of the cover is shown. In a still preferred construction, the inside surface of the cover may also be constructed to represent the under surface of the animal, or merely the mirror image of the outer surface of the panel. Alternatively, the inner surface of the cover may be used to display text, or a cartoon-like story about the animal.

Typically, the device has a post height of about 8 feet, and the tailing portions extend $$2\frac{1}{2}$$

feet to 3 feet, leaving 5 to $$5\frac{1}{2}$$

feet of clearance beneath the device. If desired the device may be anchored, as with a conventional umbrella stand.

FIGS. 2 and 2A further illustrate the device of the present invention, showing the head panel 11, of the cover, and the extended trailing portion of the head panel 12, illustrating the head of the animal, in this instance an elephant. Also shown are extended trailing leg portions with extended leg panels 15, and a tail panel 13, with extended trailing portion 14. As shown, the extended tail portion may be larger than the tail, and bear the picture of a tail, to enhance the coverage of the device. A wide variety of animals may be configured with the canopy and extended panels of the cover of the device. For example, the cover may depict a turtle, a frog, or a dog. Additionally, the cover may depict a fish with fins, or a school of fish. A portion of the cover material may be transparent to enhance the appearance of the animals.

Figure 3:
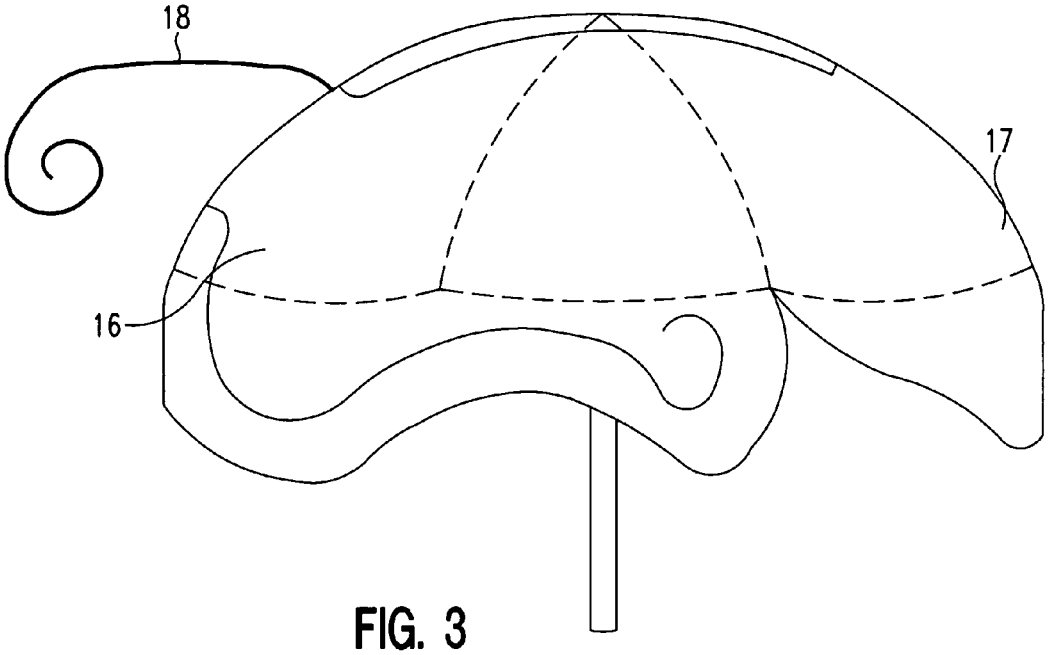
FIG. 3 is a side view of another embodiment of the present invention, depicting a butterfly play space device.

As shown in FIG. 3, the extended panels can be wing panels. As shown, wing panel 16, depicting the upper and larger wing of a butterfly, may traverse a number of ribs, while wing panel 17, representing the small, lower wing of this particular butterfly, extends between two ribs. Additional adornments, such as the proboscis, 18 may be added to enhance the likeness of the animal.

Figure 4:
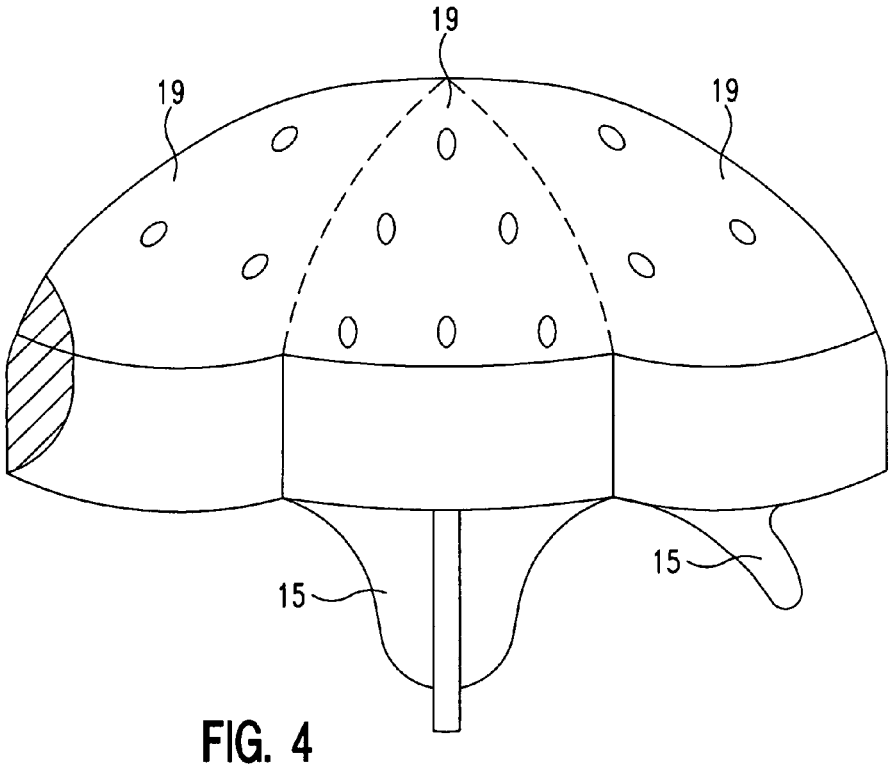
FIG. 4 is a side view of another embodiment of the present invention, depicting ladybug play space device.

FIG. 4 illustrates a device in which the animal depicted has a shell body. The panels, 19 representing the shell body may comprise most of the cover, and the head may be depicted only as a portion of one of the body panels. The leg portions with extended leg panels help to define the play space of this device.

According to the present invention, the device may have a plurality of ribs. In one preferred embodiment, the device has 4 ribs, and the cover is constructed and attached to the ribs such that the panels between the ribs depict the body portions. In many instances, the head panel will have an extended trailing portion, defining the partial walls of the play space. In some instances, the device may have an extended trailing tail portion, or leg portion, of a panel extending between two ribs. Any number of extended portions, may be used to create the partial walls of the creative, protective play space.

In another preferred embodiment, the device may have 6 ribs. In this embodiment, the device may have up to 4 leg panels. In another preferred embodiment, the device may have 8 ribs, and the animal body portions may be depicted in a head panel, a tail panel, four leg panels, and two torso panels, any or all of which may have extended portions to form the walls. In an alternative a panel may depict two legs so as to depict e.g., a lobster.

Figure 5:
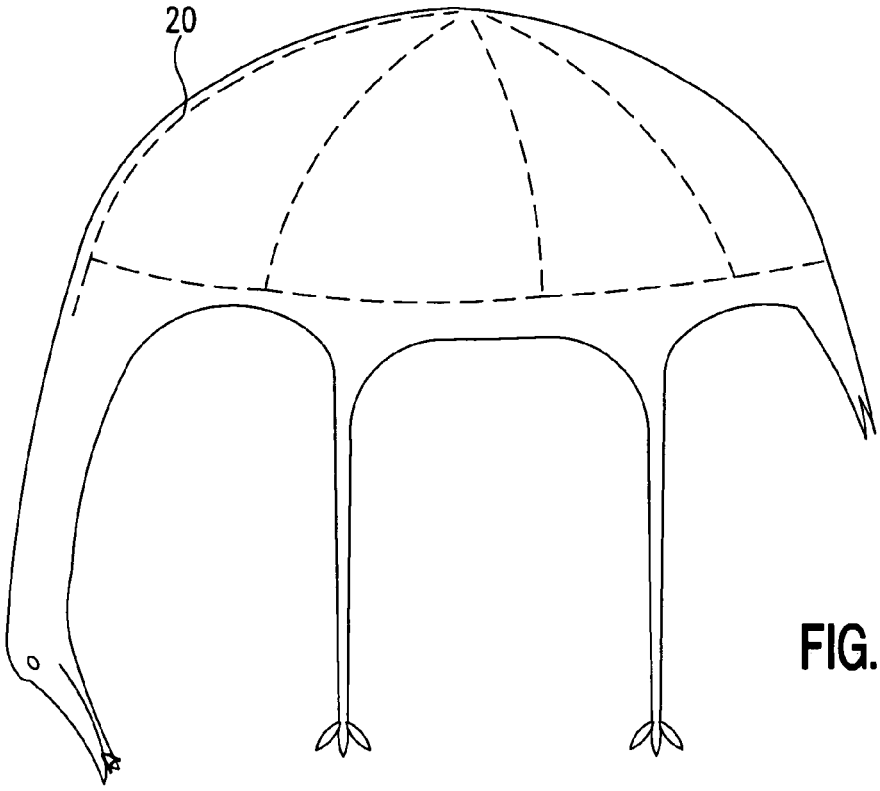
FIG. 5 is a side view of another embodiment of the present invention depicting a flamingo play space device, with the head supported by the framework.
Figure 6:
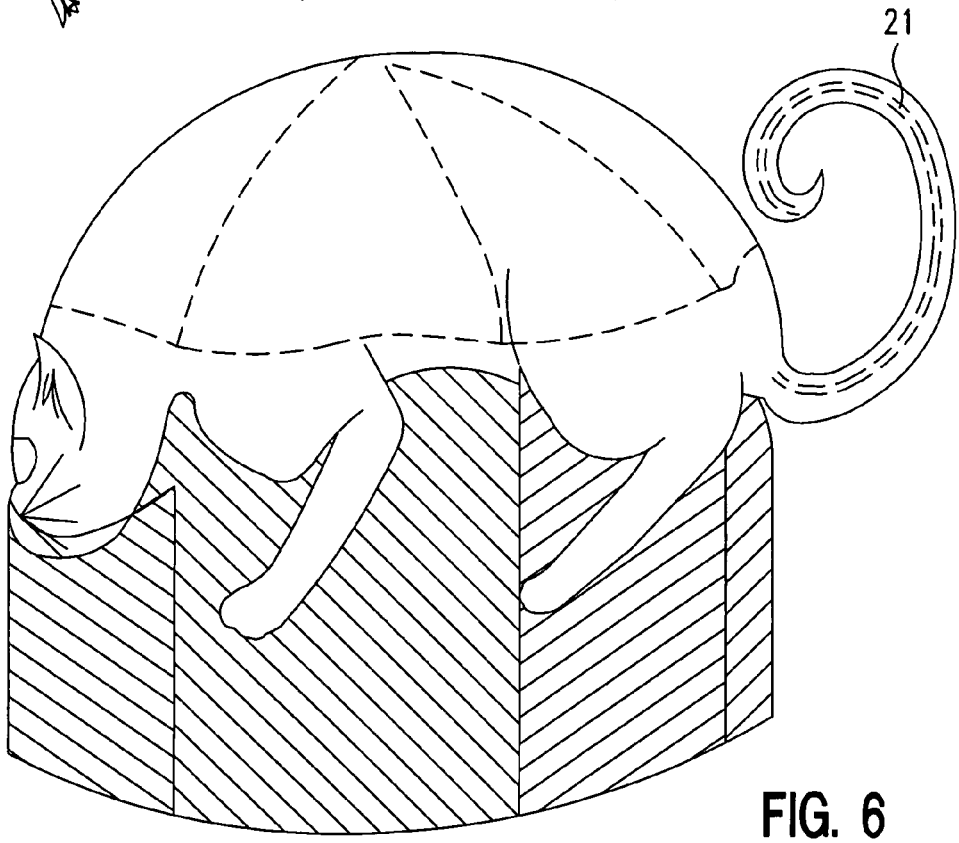
FIG. 6 is a side view of another embodiment of the present invention, illustrating a cat play space device wherein the forehead of the cat is supported by the framework.

In an alternative construction, a body portion may be supported, and shaped, by an additional shaping rib. FIG. 5 illustrates a flamingo play space device wherein the long neck of the flamingo is not stretched between ribs but is supported by a shaping rib, 20. Extra framing means may also be provided to support and shape animal shapes, as needed. In FIG. 6, the curled tail of the cat device is supported and shaped by the additional framing means 21. Additional framing means may also comprise formed shapes, such as the 3-dimensional shape of an ear, which may be attached, by any known means, to the cover.

Figure 1A:
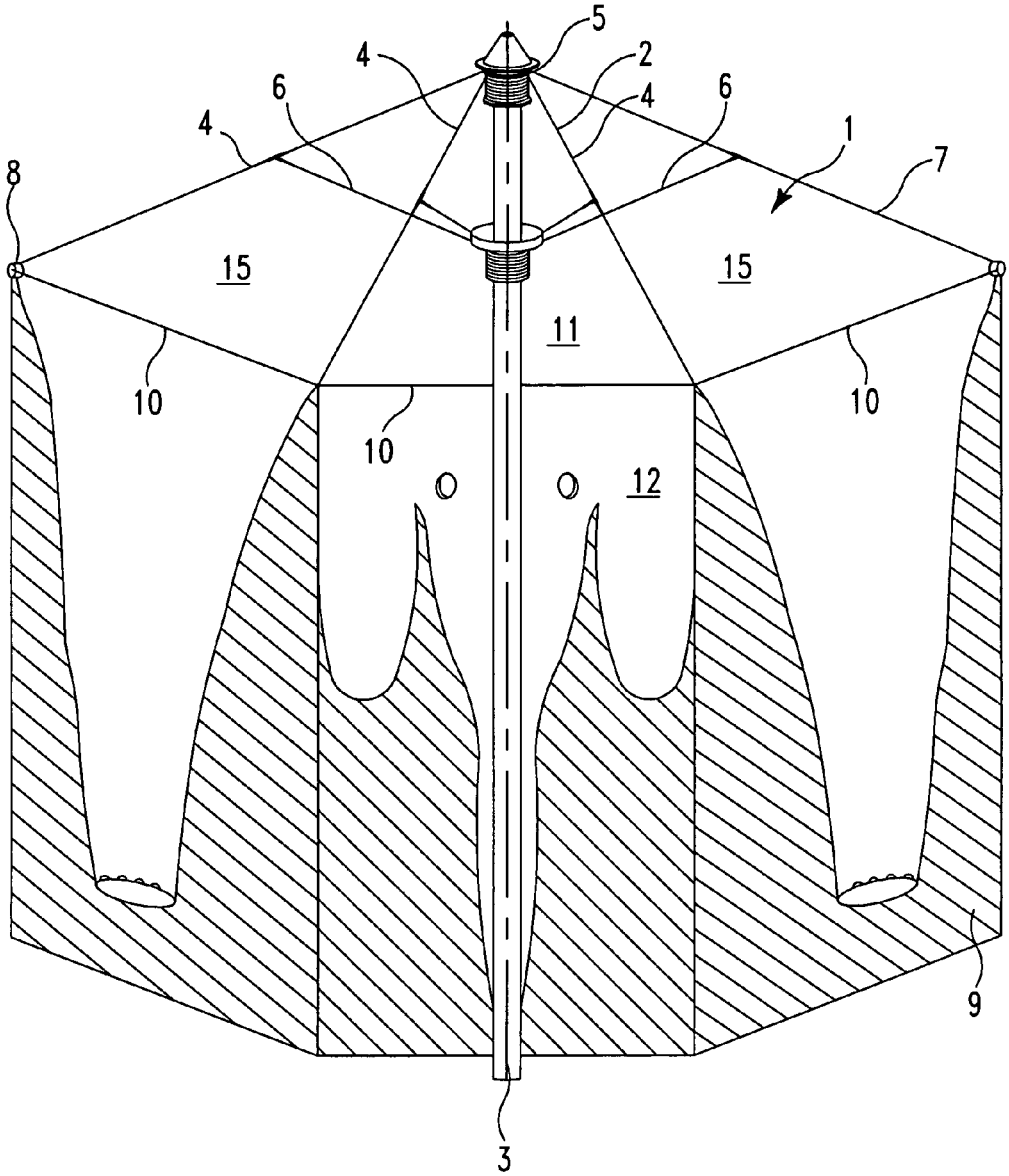
FIG. 1A is a side view in partial cross-section of another embodiment of the play space device of the present invention, illustrating the inside of the play space.

If desired, the material of the cover, 7, may bear on its undersurface a graphic depiction of the underside of the animal displayed on the outside of the play space device. Alternatively, as shown in FIG. 1A, the graphic depiction of the outer surface may be repeated on the under surface. In an alternative construction, the cover, 7, may be made of a transparent, or translucent, material; and a two-sided depiction of the animal affixed to the outer surface, or the under surface, of the transparent/translucent cover.

In constructing the creative play space device of the present invention much creativity may be used in the graphics, and the physical structure of the device. To create a non-intrusive space, the graphics on the under surface may mimic the day or night sky, and include, e.g., clouds, sun, stars, the moon, etc. In forming a creative play space device for older children, the graphics on the under surface might be a little frightening, and include the head of the animal looking underneath the device, staring at the occupants; or scientific, and include an anatomical longitudinal cross section of the animal.

Figure 7:
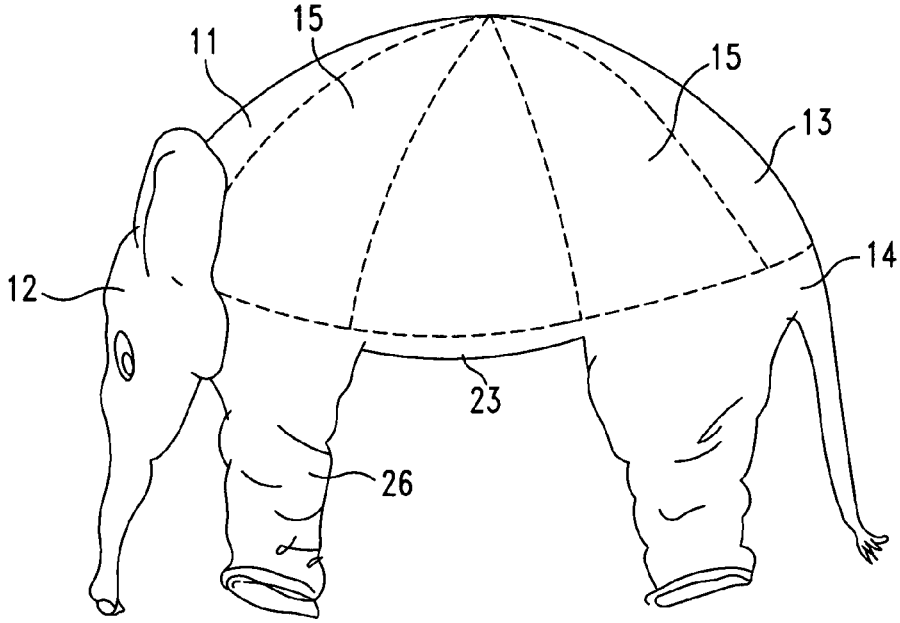
FIG. 7 is a side view of another embodiment of the present invention, depicting and elephant, and illustrating the inclusion of torso panels.

As shown in FIG. 7, the play space device may comprise eight panels. In the embodiment shown in FIG. 7, the device has a head panel 11, with a trailing portion 12, a tail portion, 13, with a trailing portion 14, and leg portions, 15, with trailing portions. In addition, the device has opposed torso portions, 22, each of which may include a small valance, 23, which may be used to complete the torso, or to conceal the underside of the device, but which does not include a trailing portion, thereby creating entrances, 26, to the play space device. Inclusion of the torso panels may also provide a more realistic depiction of an animal, such as the elephant shown in FIG. 7.

Figure 8A:
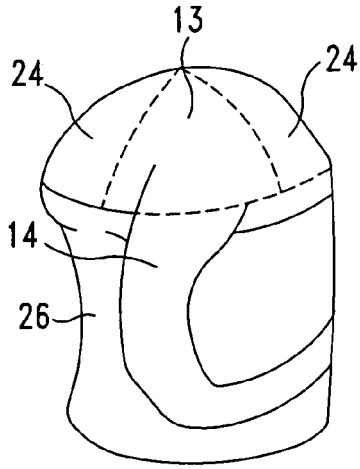
FIG. 8A is a right end view of the embodiment of FIG. 8, illustrating the animal portions on the transparent/translucent cover material.
Figure 8:
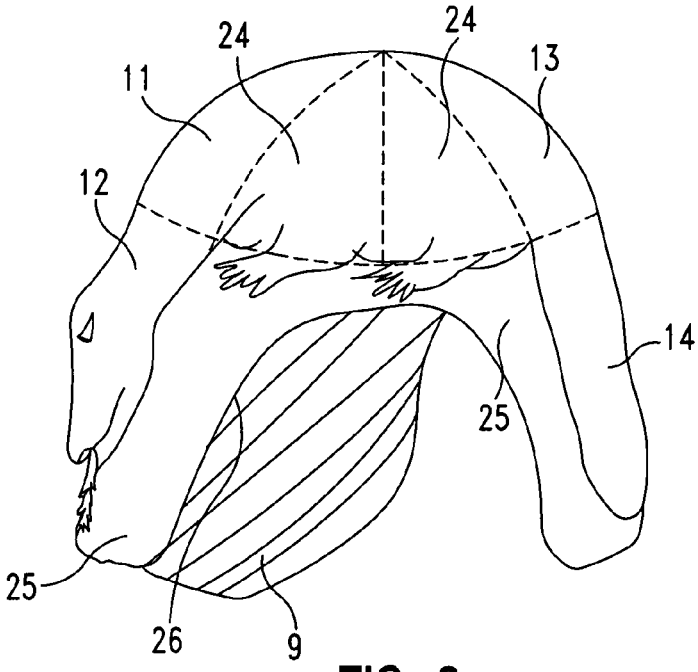
FIG. 8 is a side view of another embodiment of the invention, with only two trailing portions.

FIG. 8 illustrates an embodiment of a smaller, enclosed, play space device designed for smaller children. This embodiment includes six panels, but only 2 panels have trailing portions. As shown in FIG. 8, the gila monster depicted on at least the outer surface of the cover, has a head panel, 11, with a trailing portion, 12, and a tail panel, 13, with a trailing portion, 14. Between the head and tail panels, are leg panels 24, which do not include a trailing portion, but may include a valance, for the reasons recited above with respect to FIG. 7. As shown in FIG. 8, the play space device includes two panels 24 between the each head panel and tail panel. It is also possible to construct this smaller play space device with only one panel, 24, between each head panel and the tail panel; producing a four-sided, pyramid type of structure rather than a hemispherical dome structure.

If desired, the translucent or transparent material, 25, of the cover may be extended to create a more complete play space, as shown in FIG. 8. The transparent material need not be divided into distinct trailing panels, connected to distinct ribbed panels of the device. Transparent netting material, 9, may be combined with the transparent/translucent material as needed cover entrances while providing airflow. As shown in FIG. 8A, extension of the transparent material permits a feature such as the tail, to curl around the side of the play device, leaving only one entrance, 26, to the play device.

There has thus been shown and described a novel protective creative play space device which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A protective, creative play space device, comprising:

a) a framework comprising a post and a plurality of ribs extending outward therefrom, each rib having two ends and being connected at one end thereof to the post;

b) framing means for maintaining the ribs at an angle to the post; and c) a cover of protective material, disposed about the framework, the cover having a top portion being attached to said post and said ribs, the cover extending beyond the other end of the ribs and forming a trailing portion which falls toward the ground, creating a protective creative play space inside a partial wall, the cover, on the top portion and at least a part of the trailing portion thereof, having continuously formed thereon an image of an animal.

2. A protective, creative play space device, as in claim 1, wherein the ribs are pivotably connected to the post, whereby said device forms an umbrella-like structure.

3. A protective, creative play space device as in claim 1, wherein the trailing portion further comprises netting, which together with the portions thereof bearing the image of the animal, creates a complete canopy over the play space.

4. The protective, creative play space device of claim 1, having at least 4 ribs, said ribs defining a plurality of panels on the trailing portion, on one of which panels is formed the image of a head of the animal.

5. The protective, creative play space device of claim 4, wherein the image includes a tail of the animal being formed on one of the panels.

6. The protective, creative play space device of claim 5, wherein the image includes at least one leg of the animal being formed on at least one of the panels.

7. The protective, creative play space device of claim 6, wherein the images of the head, a tail and at least two legs of the animal are respectively formed on separate panels.

8. The protective, creative play space device of claim 4, wherein the image includes at least one wing of the animal being formed on one of the panels.

9. The protective, creative play space device of claim 1, wherein the image is a body of the animal being formed on the top portion of the cover.

10. The protective, creative play space device of claim 4, having at least 6 ribs.

11. The protective, creative play space device of claim 4, having at least 8 ribs.

12. The protective, creative play space device of claim 11, wherein the image includes a tail of the animal being formed on one of the panels.

13. The protective, creative play space device of claim 12, wherein the image includes at least one leg of the animal being formed on at least one of the panels.

14. The protective, creative play space device of claim 13, wherein the images of four legs of the animal are respectively formed on separate panels.

15. The protective, creative play space device of claim 14, wherein the image is a body of the animal being formed on the top portion of the cover.

16. A protective, creative play space device for children as in claim 1, further comprising at least one shaping rib, shaping a portion of the cover on which is formed the image of a body portion of the animal.

17. A protective, creative play space device for children as in claim 1, further comprising additional framing means for shaping the image of a part of the animal.

18. A protective, creative play space device as in claim 1, wherein the cover comprises transparent or translucent material permitting the image of parts of the animal on the cover to be seen from within the creative play space.

19. A protective, creative play space device as in claim 18, wherein the transparent or translucent material creates a partial canopy, with one entrance.

20. A protective, creative play space device as in claim 1, wherein both an undersurface and an outer surface of the cover bear images of parts of the animal.

* * * * *